US006951045B2

(12) United States Patent
Thur et al.

(10) Patent No.: US 6,951,045 B2
(45) Date of Patent: Oct. 4, 2005

(54) VACUUM CLEANER HAVING HOSE DETACHABLE AT NOZZLE

(75) Inventors: Charles J. Thur, Broadview Hts., OH (US); Steven J. Paliobeis, Painesville, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 376 days.

(21) Appl. No.: 10/224,483

(22) Filed: Aug. 20, 2002

(65) Prior Publication Data

US 2004/0034962 A1 Feb. 26, 2004

(51) Int. Cl.[7] ..... A47L 5/36

(52) U.S. Cl. ..... 15/334; 15/352; 15/353; 15/350

(58) Field of Search ..... 15/350, 351, 352, 15/353, 334; 55/DIG. 3, 337, 429, 459.1

(56) References Cited

U.S. PATENT DOCUMENTS

| | | | |
|---|---|---|---|
| 930,125 | A | 8/1909 | Barrett |
| 1,003,844 | A | 9/1911 | Winans |
| 1,029,562 | A | 6/1912 | Prentiss |
| 1,133,543 | A | 3/1915 | Duffie |
| 1,167,219 | A | 1/1916 | Replogle |
| 1,230,827 | A | 6/1917 | Duffie |
| 1,234,095 | A | 7/1917 | Duffie |

(Continued)

FOREIGN PATENT DOCUMENTS

| | | |
|---|---|---|
| EP | 0042 723 | 12/1981 |
| EP | 0 489 468 | 6/1992 |
| FR | 1468142 | 4/1967 |
| GB | 479455 | 2/1938 |
| GB | 1049292 | 2/1964 |
| GB | 1111074 | 4/1968 |
| GB | 2265096 | 9/1993 |
| GB | 2280388 A | 2/1995 |
| GB | 2298598 | 9/1996 |
| JP | H3 103057 | 10/1991 |
| JP | 3 103059 | 10/1991 |
| WO | WO 84/02282 | 6/1984 |
| WO | WO 99/30602 | 6/1999 |
| WO | WO 99/30604 | 6/1999 |
| WO | WO 99/30605 | 6/1999 |

OTHER PUBLICATIONS

Fantom Vacuum Cleaner Owner's Manual (© 1993).
Fantom Fury Vacuum Cleaner Owner's Manual (© 1995).
Fantom Vacuum Cleaner Service Manual for Iona® Model Series F–9000.
Japanese Language Brochure Concerning National Product No. MC–11OU, Feb. 1981.
Dyson DC 03 Operating Manual, Dec. 11, 1997.
"Flair on the Floor" Appliance, Dec. 1994, pp. 24–28.
Pictures of Shop–Vac QSP 16 Gallon Wet/Dry Vacuum and Excerpt of Shop Vac Article, Popular Mechanics, Sep. 1996, p. 88.
"The Bagless Vac A World First", Appliance Manufacturer, Feb. 1992, pp. 21–22.

*Primary Examiner*—Theresa T. Snider
(74) *Attorney, Agent, or Firm*—Fay, Sharpe, Fagan, Minnich & McKee, LLP

(57) ABSTRACT

An upright vacuum cleaner is provided. The upright vacuum cleaner includes a nozzle base section including a main suction opening formed in an underside thereof. An upright housing section is hingedly connected with the nozzle base section. The housing section includes a cyclonic airflow chamber and a dirt cup for receiving dirt and dust separated by the cyclonic airflow chamber. A hose connects the nozzle base section to the upright section and is selectively detachable from the nozzle base section. The hose communicates an airstream that flows from the main suction opening to airflow chamber. A suction source is located in one of the upright housing section and the nozzle base section and is in fluid communication with the cyclonic airflow chamber. A filter assembly is located in an airflow chamber upstream from the suction source.

53 Claims, 12 Drawing Sheets

U.S. PATENT DOCUMENTS 1,557,212 A * 10/1925 Lee ..... 15/351
1,768,617 A 7/1930 Lee
1,887,600 A 11/1932 Replogle
2,019,895 A 11/1935 Dow
2,171,248 A 8/1939 Van Berkel
2,187,164 A 1/1940 Leathers
2,242,278 A * 5/1941 Yonkers, Jr. ..... 55/DIG. 3
2,260,222 A 10/1941 Hahn
2,266,075 A 12/1941 Replogle
2,316,836 A 4/1943 Breuer
2,394,923 A 2/1946 Little
2,475,808 A 7/1949 Storm, Jr.
2,507,897 A 5/1950 Gavagnin
2,516,707 A 7/1950 Lewyt et al.
2,524,117 A 10/1950 Storm, Jr.
2,542,634 A 2/1951 Davis et al.
2,564,339 A 8/1951 Nerheim
2,610,702 A 9/1952 Thornwald
2,643,733 A 6/1953 Shellman
2,898,622 A 8/1959 Hurd
2,921,646 A 1/1960 Poole
3,039,129 A 6/1962 Belicka et al.
3,177,635 A 4/1965 Cawl et al.
3,320,727 A 5/1967 Farley et al.
3,413,779 A 12/1968 Takahashi et al.
3,543,325 A 12/1970 Hamrick
3,614,860 A 10/1971 Grelisson
3,626,545 A 12/1971 Sparrow
3,704,482 A 12/1972 Brannon ..... 15/348
3,755,843 A * 9/1973 Goertzen et al. ..... 15/350
3,797,064 A 3/1974 MacFarland
3,820,310 A 6/1974 Fromknecht et al.
3,853,518 A 12/1974 Tu et al.
3,910,781 A 10/1975 Bryant, Jr.
4,072,483 A 2/1978 Doyle, Jr.
4,108,778 A 8/1978 Lambert et al.
4,118,208 A 10/1978 Klinedinst
4,172,710 A 10/1979 van der Molen ..... 15/353
4,198,726 A 4/1980 Powell, Jr. ..... 55/337
4,268,288 A 5/1981 Coombs
4,276,070 A 6/1981 Hug
4,284,422 A 8/1981 Ferland
4,355,434 A 10/1982 Gongwer
4,373,228 A 2/1983 Dyson
4,376,322 A 3/1983 Lockhart et al. ..... 15/323
4,426,211 A 1/1984 Ataka et al.
4,443,235 A 4/1984 Brenholt et al.
4,457,043 A 7/1984 Oeberg et al.
4,486,206 A 12/1984 Miyakawa et al.
4,571,772 A 2/1986 Dyson ..... 15/352
4,573,236 A 3/1986 Dyson ..... 15/333
4,581,787 A 4/1986 Torigoe et al.
4,593,429 A 6/1986 Dyson
4,643,748 A 2/1987 Dyson
4,665,582 A 5/1987 Richmond et al. ..... 15/344
4,686,736 A 8/1987 Petralia et al. ..... 15/332
4,718,924 A 1/1988 DeMarco
4,720,887 A * 1/1988 Bosyj et al. ..... 15/351
RE32,751 E 9/1988 Joss et al.
4,769,052 A 9/1988 Kowalski
4,826,515 A 5/1989 Dyson
4,853,008 A 8/1989 Dyson
4,853,011 A 8/1989 Dyson
4,934,019 A 6/1990 Shorthill et al.
4,944,780 A 7/1990 Usmani
4,960,446 A 10/1990 Werner et al.
4,967,443 A 11/1990 Krasznai et al.
5,018,240 A 5/1991 Holman
5,020,186 A 6/1991 Lessig, III et al. ..... 15/339
5,062,870 A 11/1991 Dyson
5,078,761 A 1/1992 Dyson
5,080,697 A 1/1992 Finke
5,090,975 A 2/1992 Requejo et al.
5,090,976 A 2/1992 Dyson
5,101,532 A 4/1992 Dyson et al.
5,106,488 A 4/1992 Jonasson
5,107,567 A 4/1992 Ferrari et al.
5,129,125 A 7/1992 Gamou et al.
5,135,552 A 8/1992 Weistra
5,145,499 A 9/1992 Dyson ..... 55/337
5,160,356 A 11/1992 Dyson
5,168,598 A * 12/1992 Hashizume et al. ..... 15/351
5,230,722 A 7/1993 Yonkers
5,248,323 A 9/1993 Stevenson ..... 96/90
5,254,147 A 10/1993 Finke ..... 55/337
5,267,371 A 12/1993 Soler et al.
5,271,751 A 12/1993 Lagler
5,287,591 A 2/1994 Rench et al. ..... 15/328
5,307,538 A 5/1994 Rench et al.
5,388,303 A 2/1995 Hemmann et al. ..... 15/334
5,427,597 A 6/1995 Osendorf
5,464,460 A 11/1995 Bosses
5,524,321 A 6/1996 Weaver et al.
5,558,697 A 9/1996 Dyson et al.
5,593,479 A 1/1997 Frey et al. ..... 96/57
5,603,741 A 2/1997 Frey
5,617,611 A 4/1997 Wörwag ..... 15/331
5,659,922 A 8/1997 Louis ..... 15/350
5,685,894 A 11/1997 Bowerman et al.
5,704,956 A 1/1998 Loveless et al.
5,725,623 A 3/1998 Bowerman et al.
5,732,439 A 3/1998 Cipolla ..... 15/351
5,746,795 A 5/1998 Witter
5,779,745 A 7/1998 Kilström ..... 15/353
5,795,358 A 8/1998 Scanlon et al.
D398,097 S 9/1998 Murphy et al.
5,829,090 A 11/1998 Melito et al.
5,850,666 A 12/1998 Farone et al. ..... 15/339
5,867,863 A 2/1999 McCormick
5,922,093 A 7/1999 James et al.
5,935,279 A 8/1999 Kilström ..... 15/353
5,946,771 A 9/1999 Bosyj et al.
5,961,677 A 10/1999 Scott
6,003,196 A 12/1999 Wright et al. ..... 15/353
6,012,200 A 1/2000 Murphy et al.
6,026,540 A 2/2000 Wright et al. ..... 15/347
6,035,486 A 3/2000 McCormick
6,070,291 A 6/2000 Bair et al. ..... 15/347
6,079,077 A 6/2000 Kajihara et al. ..... 15/332
6,085,382 A 7/2000 Bobrosky et al.
6,146,434 A 11/2000 Scalfani et al. ..... 15/353
6,192,550 B1 2/2001 Hamada et al.
6,256,834 B1 7/2001 Meijer et al.
6,260,234 B1 7/2001 Wright et al. ..... 15/353
6,317,921 B1 11/2001 Park et al. ..... 15/334
6,341,404 B1 1/2002 Salo et al. ..... 15/353
6,353,963 B1 3/2002 Bair et al. ..... 15/351
6,375,696 B2 4/2002 Wegelin et al. ..... 15/353
6,401,295 B2 6/2002 Bair et al. ..... 15/352
6,428,589 B1 8/2002 Bair et al. ..... 15/353
6,484,350 B2 * 11/2002 Yung ..... 15/352
6,488,744 B2 * 12/2002 Cartellone ..... 15/353
6,502,277 B1 * 1/2003 Petersson et al. ..... 15/352
6,558,453 B2 * 5/2003 Sepke et al. ..... 15/353
6,640,385 B2 * 11/2003 Oh et al. ..... 15/352
6,647,587 B1 * 11/2003 Ohara et al. ..... 15/350
6,807,708 B2 * 10/2004 Roney et al. ..... 15/351
2002/0095741 A1 * 7/2002 Inoue et al. ..... 15/350
2004/0134022 A1 * 7/2004 Murphy et al. ..... 15/353

* cited by examiner

VACUUM CLEANER HAVING HOSE DETACHABLE AT NOZZLE

BACKGROUND OF THE INVENTION

The present invention relates to vacuum cleaners. More particularly, the present invention relates to upright vacuum cleaners used for suctioning dirt and debris from carpets and floors.

Upright vacuum cleaners are ubiquitous. They are known to include an upper portion having a handle, by which an operator of the vacuum cleaner may grasp and maneuver the cleaner, and a lower cleaning nozzle portion which travels across a floor, carpet, or other surface being cleaned. The upper portion is often formed as a rigid plastic housing which encloses a dirt and dust collecting filter bag, although the upper portion may simply be an elongated handle with the filter bag, and an external cloth bag enclosing it, hung therefrom. The cleaning nozzle is hingedly connected to the upper handle portion such that the upper portion is pivotable between a generally vertical upright storage position and an inclined operative position. The underside of the nozzle includes a suction opening formed therein which is in fluid communication with the filter bag.

A vacuum or suction source such as a motor and fan assembly is enclosed either within the nozzle portion or the upper portion of the cleaner. The vacuum source generates the suction required to pull dirt from the carpet or floor being vacuumed through the suction opening and into the filter bag. A rotating brush assembly is typically provided in proximity with the suction opening to loosen dirt and debris from the surface being vacuumed.

To avoid the need for vacuum filter bags, and the associated expense and inconvenience of replacing the bag, another type of upright vacuum cleaner utilizes cyclonic airflow, rather than a filter bag, to separate a majority of the dirt and other particulates from the suction airstream. In some types of cyclonic vacuum cleaners, the air flows through a filter to remove residual particulates, before it flows to the motor. Some non-cyclonic upright vacuum cleaners also employ a filter and a dust cup.

Such prior art upright vacuum cleaners have not been found to be entirely effective and convenient to use. For example, with these prior art vacuum cleaners, the process of emptying dust and dirt from the dirt collection container has been found to be inconvenient, and often resulted in the spillage of the cup contents. Likewise, with these prior units, replacement of the filter element has not been convenient. Further, other prior art vacuum cleaners have been found to exhaust air which is not free of residual contaminants. For example, one prior unit filters the airstream after it passes through the cyclonic chamber, but thereafter passes the airstream through the motor assembly where it is potentially recontaminated by the motor assembly, itself, prior to its being exhausted into the atmosphere.

Because a single stage dust separation action of such vacuum cleaners does not completely remove all dust, dirt, and other contaminants from the suction airstream, it has been found desirable to include a filter downstream from the dust separation chamber. As such, prior art vacuum cleaners have heretofore employed cylindrical or planar filter elements including conventional media to filter the airstream after it passes through the dust separation chamber. These prior art filter elements are not optimum for all environments. Thus, a need has been found for a bagless vacuum cleaner with an effective filter positioned downstream relative to a dust separation chamber for effectively filtering the airstream without clogging.

Further, there is a need for a bagless vacuum cleaner that is readily usable for on-floor cleaning and above-floor cleaning. It would be additionally desirable for such a vacuum cleaner to be relatively simple and/or relatively inexpensive to manufacture and assemble. Accordingly, it has been deemed desirable to develop a new and improved upright vacuum cleaner which would overcome the foregoing difficulties and others while providing better and more advantageous overall results.

BRIEF SUMMARY OF THE INVENTION

In accordance with one of the present invention, a new and improved upright vacuum cleaner is provided. More particularly, in accordance with this aspect of the invention, the upright vacuum cleaner includes a nozzle base section including a main suction opening formed in an underside thereof. An upright housing section is hingedly connected with the nozzle base section. The housing section includes a dirt separation chamber and a dirt receptacle for receiving dirt and dust separated by the dirt separation chamber. A hose connects the nozzle base section to the upright section and is selectively detachable from the nozzle base section. The hose communicates an airstream that flows from the main suction opening to the dirt separation chamber. The suction source is located in one of the upright housing section and the nozzle base section and is in fluid communication with the dirt separation chamber. A filter assembly is located in said dirt separation chamber upstream from the suction source.

According to another aspect of the present invention, a new and improved vacuum cleaner is provided. More particularly, in accordance with this aspect of the invention, the vacuum cleaner includes a housing defining a cyclonic airflow chamber for separating contaminants from a suction airstream. The housing further includes an inlet for the cyclonic airflow chamber and an outlet for the cyclonic airflow chamber. A dirt container is selectively mounted in the housing for receiving and retaining dirt and dust separated from the suction airstream. An airstream suction source is in fluid communication with the cyclonic airflow chamber and has an inlet disposed downstream from the cyclonic airflow chamber outlet. A generally conical-shaped filter assembly is positioned between the cyclonic airflow chamber and the suction source for filtering contaminants from the suction airstream.

According to still another aspect of the present invention, a vacuum cleaner is provided. More particularly, in accordance with this aspect of the invention, the vacuum cleaner includes a first housing member including a cyclonic airflow chamber adapted for separating entrained dirt and dust from a circulating airstream. A second housing member defines a main suction opening. A first conduit fluidly connects the main suction opening to an inlet of the cyclonic airflow chamber. At least a portion of the first conduit is selectively releasable from the second housing member. An airstream source is mounted to one of the first and second housing members and is positioned downstream from the cyclonic airflow chamber. The airstream source is adapted for generating and maintaining an airstream flowing through the cyclonic airflow chamber.

According to another aspect of the present invention a new and improved vacuum cleaner is provided. More particularly, in accordance with this aspect of the invention, the vacuum cleaner includes a nozzle section and a housing section connected to the nozzle section. The housing section is in fluid communication with the nozzle section. A dirt separation chamber is located in the housing section for separating dirt and dust from a suction airstream flowing into the housing section between an inlet located at a periphery of the housing section and an outlet. A suction source is in fluid communication with the dirt separation chamber. A tapered filter assembly is located in the dirt separation chamber for further separating dirt and dust from the suction airstream.

According to still another aspect of the present invention, a new and improved vacuum cleaner is provided. More particularly, in accordance with this aspect of the invention, the vacuum cleaner includes a housing including a suction opening thereon. A dust cup is mounted in the housing in fluid communication with the suction opening. A tapered filter is mounted in the dust cup such that a larger diameter end is located adjacent a base wall of the dust cup. A suction source is in fluid communication with the dust cup and is located downstream of the dust cup for generating and maintaining a suction airstream from the suction opening through the tapered filter.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE INVENTION

Figure 1:
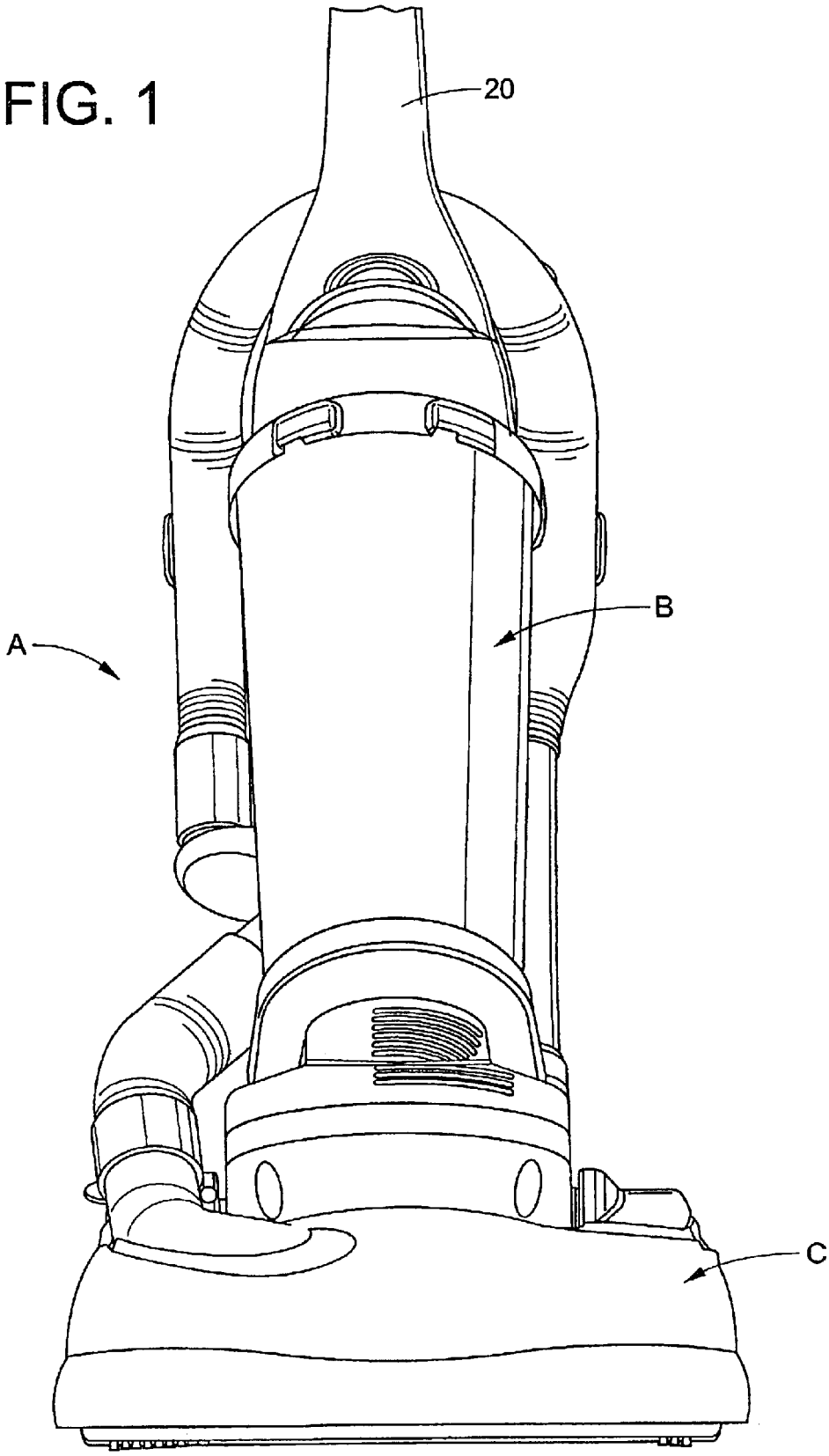
FIG. 1 is a front elevational view of a vacuum cleaner in an inclined use position, and having a hose selectively detachable from a nozzle base for above-floor cleaning, according to the present invention.

Referring now to the FIGURES, wherein the showings are for purposes of illustrating a preferred embodiment of the invention only and not for purposes of limiting the same, FIG. 1 illustrates an upright cyclonic airflow-type vacuum cleaner A including a first or upright housing section B and a second or nozzle base section C. With additional reference to FIG. 2, the sections B,C are pivotally or hingedly connected through the use of trunnions or another suitable conventional hinge assembly D so that the upright housing section B pivots between a generally vertical position and an inclined position. Both the upright and nozzle sections or members B,C are preferably made from conventional materials such as molded plastics and the like. The upright section B includes a handle 20 extending upward therefrom by which an operator of the vacuum cleaner A is able to grasp and maneuver the vacuum cleaner A.

Figure 11:
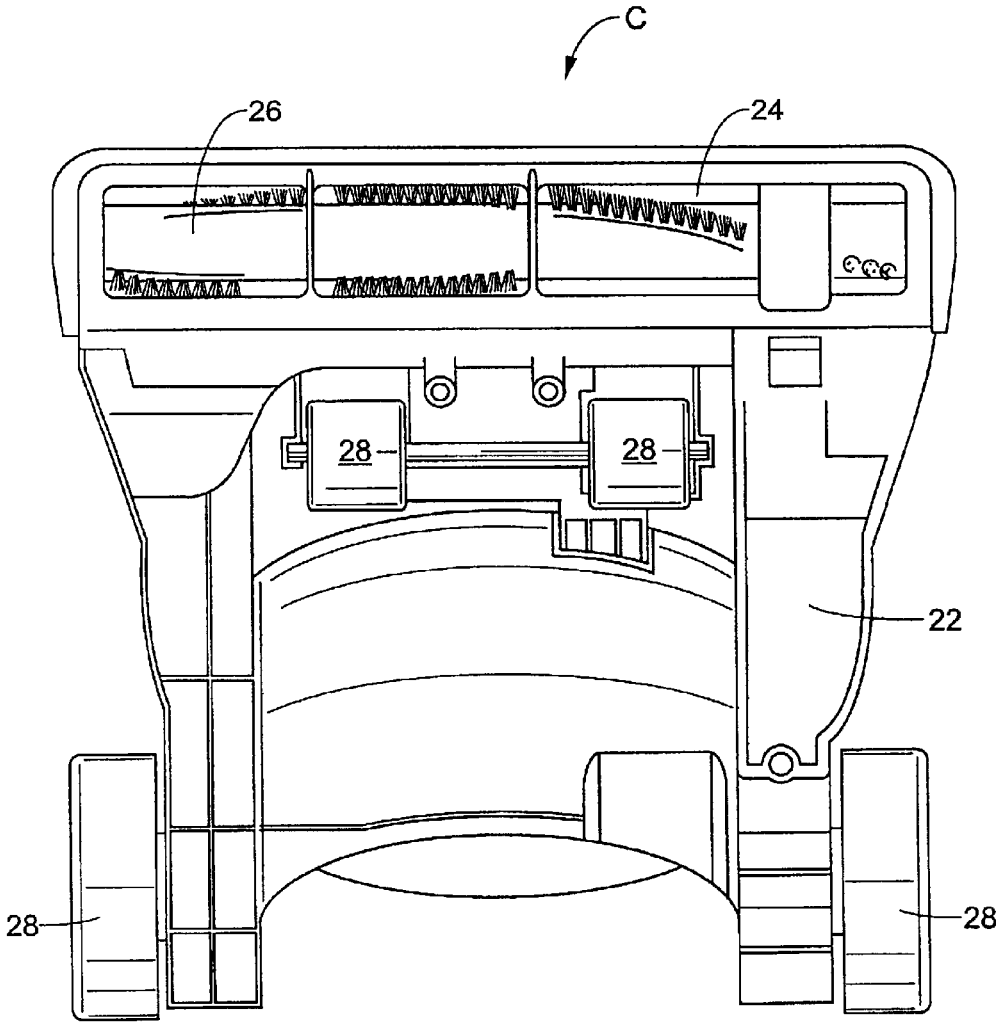
FIG. 11 is an enlarged bottom plan view of the vacuum cleaner of FIG. 1.

During vacuuming operations, the nozzle base C travels across the floor, carpet, or other subjacent surface being cleaned. With reference to FIG. 11, an underside 22 of the nozzle base C includes a main suction opening 24 formed therein which can extend substantially across the width of the nozzle base B at a front end thereof. The main suction opening 24 is in fluid communication with the vacuum upright housing section B as will be described in more detail below. A rotating brush assembly 26 is positioned in the region of the nozzle main suction opening 24 for contacting and scrubbing the surface being vacuumed to loosen embedded dirt and dust. A plurality of wheels 28 support the nozzle B on the surface being cleaned and facilitate its movement thereacross.

Figure 7:
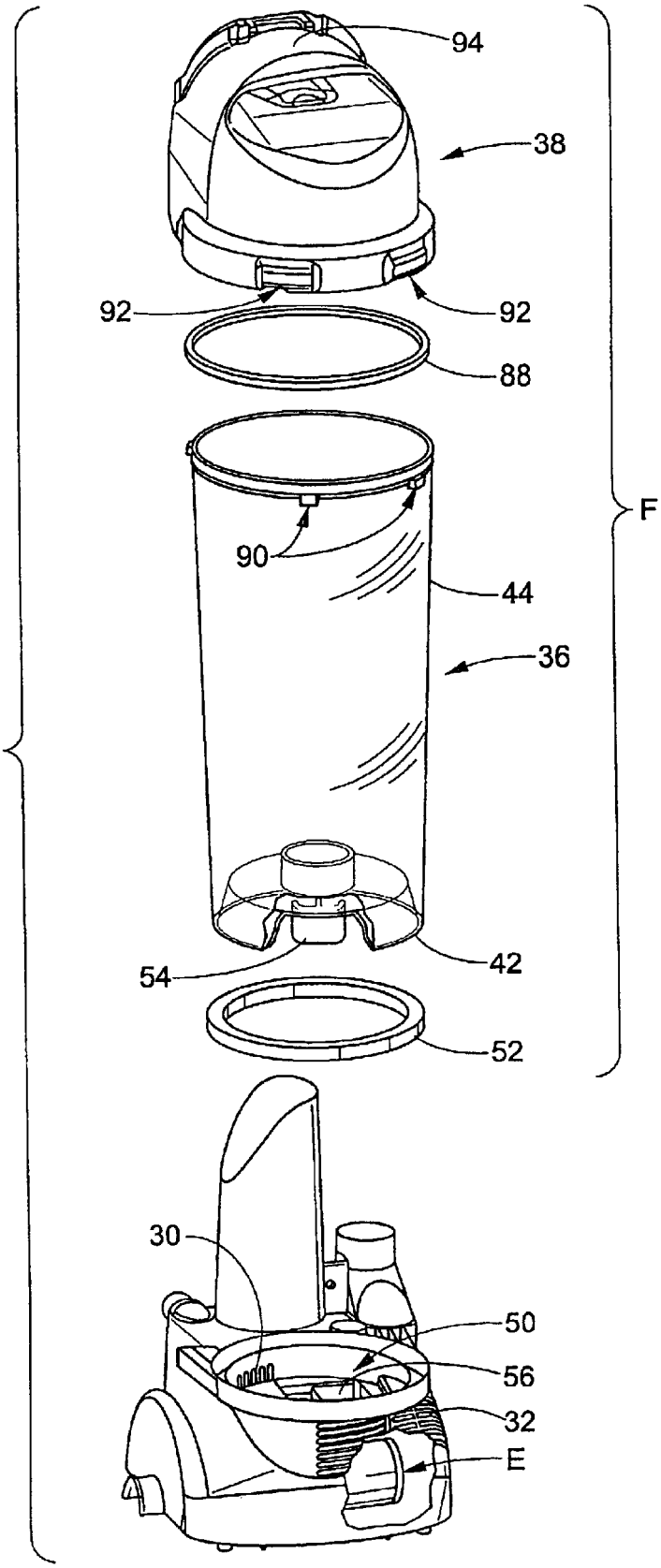
FIG. 7 is an exploded perspective view showing a dirt cup and cap assembly that defines the airflow chamber of FIG. 2.

The vacuum cleaner A includes a vacuum or suction source for generating the required suction airflow for cleaning operations. With reference now to FIG. 7, a suitable conventional suction source, such as an electric motor and fan assembly E located in the upper housing section B, generates a suction force in a suction inlet 30 and an exhaust force in an exhaust outlet 32. The suction inlet 30 of the motor and fan assembly E is in fluid communication with a dust and dirt separating region F of the vacuum cleaner A.

Figure 2:
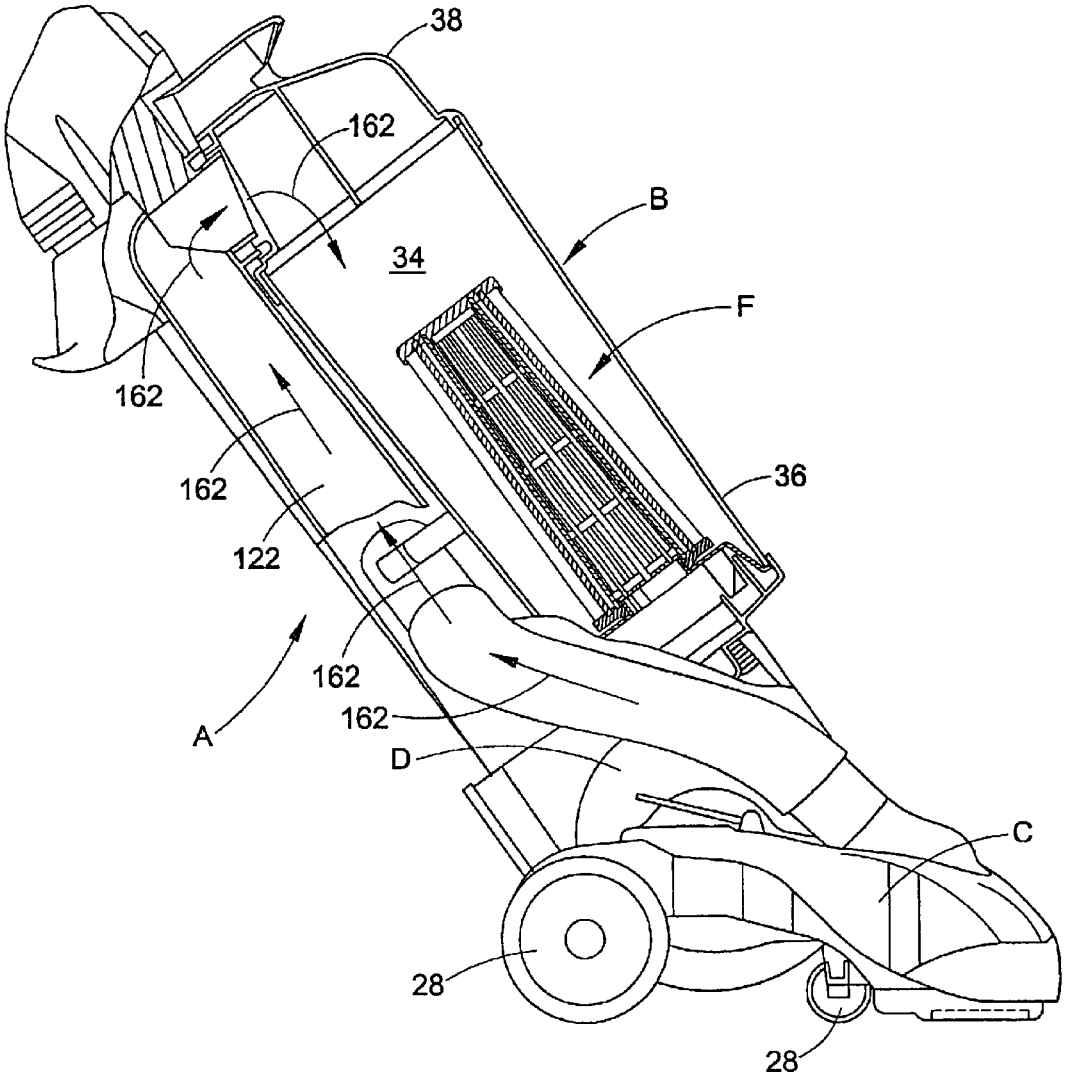
FIG. 2 is a side elevational view, in partial cross-section of the vacuum cleaner of FIG. 1 showing a flow path or suction airstream that flows from the nozzle base through the selectively detachable hose and into a dust separation chamber.

With reference to FIG. 2, the dust and dirt separating region F housed in the upright section or housing B can, in this embodiment, include a cyclonic airflow chamber 34 defined by a dirt cup, receptacle or container 36 and a dirt cup cap 38. The dirt cup and cap assembly 36,38 is capable of being detachably mounted to the upper housing B having the suction source positioned therebelow and adapted to receive and retain dirt and dust separated by the cyclonic airflow chamber 34, as will be described in more detail below. Although the presently preferred embodiment of the present invention is shown with a dust cup, it is contemplated that many aspects of the present invention could be used in a vacuum cleaner having a dirt container of a different shape such as a box-shape or with a different structure such as a filter bag. All such configurations for the dirt receptacle 36 are considered within the scope of the present invention. Further, the suction source can alternatively be positioned at other locations on the vacuum cleaner and in the suction airstream. For example, the suction source could be located upstream of the dust cup 36 whereby it would exhaust towards the dust cup 36.

Figure 3:
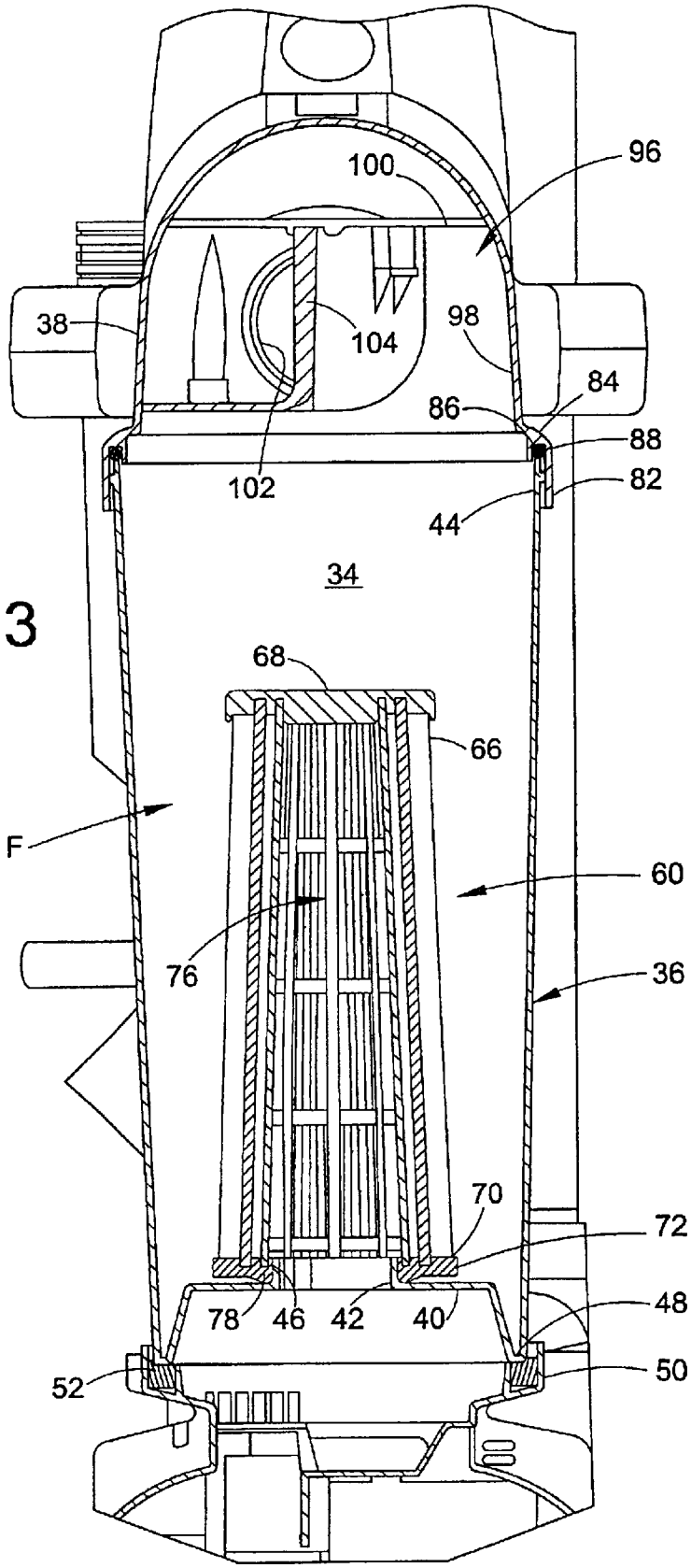
FIG. 3 is an enlarged partial front cross-sectional view of the vacuum cleaner of FIG. 1 showing the dust separation chamber and a filter assembly located therein.

More specifically, with additional reference to FIG. 3, the dirt cup 36 has a substantially closed lower end or base wall 40 having an aperture 42 extending therethrough and an open upper end 44. The aperture 42 can be centrally positioned in the base wall 40. The base wall 40 includes an annular flange 46 that defines the aperture 42, also referred to herein as an airflow chamber outlet, and extends toward the chamber 34 from the base wall or lower end 40. The lower end 40 further includes a skirt 48 for seating the dirt cup and cap assembly 36,38 in a cup-shaped receiving portion 50 of the upper section B. The receiving portion 50 includes an elastomeric ring seal 52 that seals between the receiving portion 50 and the dirt cup 36 for preventing airflow from passing therebetween. With reference to FIG. 7, the dirt cup 36 includes a protrusion 54 for mating engagement with a protrusion pocket 56 disposed on the receiving portion 50 to properly align and position the dirt cup and cap assembly 36,38 in the upper housing B. The mating engagement between the protrusion 54 and the protrusion pocket 56 allows the dirt cup and cap assembly 36,38 to be pivoted within the receiving portion 50.

Figure 6:
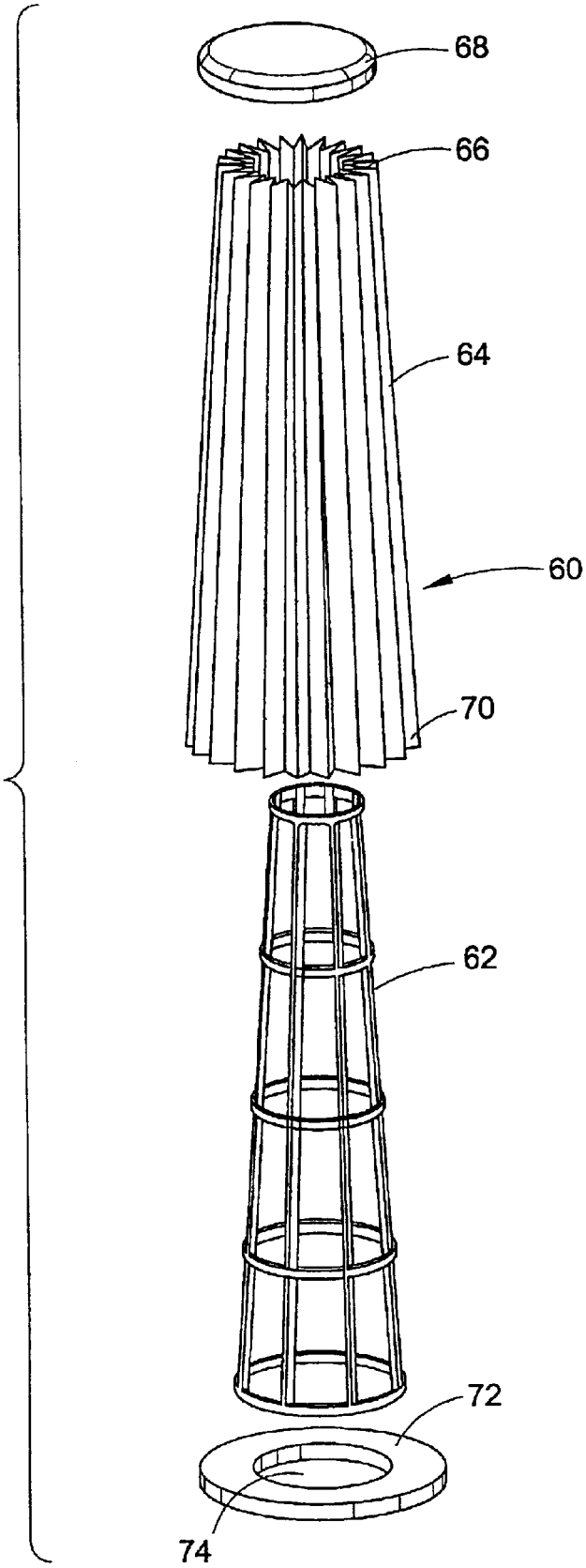
FIG. 6 is an exploded perspective view of the filter assembly of FIG. 3.

With reference again FIG. 3, a filter assembly 60 is disposed within a portion of the chamber 34 defined by the dirt cup 36 upstream from the suction source. With additional reference to FIG. 6, the filter assembly 60 can include a frustoconical or tapered frame or support member 62 that supports a frustoconical or tapered filter media or element 64 mounted on the frame 62 in an annular manner. More specifically, an interior surface of the filter element 64 can substantially match the exterior surface of the frame 62. It is believed that the conical shape of the filter improves filtering efficiency, as compared with a right cylindrical shaped filter employed by the prior art. This may be due, at least in part, to the conical shape of the filter assembly 60 which allows for a relatively large communication aperture such as aperture 42 that does not unduly restrict airflow while also permitting the remainder of the filter assembly 60 to be spaced gradually farther away from an inner surface of the dust cup 36. The conical filter shape also allows for easier emptying of the dirt cup 36 and may reduce the rate at which the filter element 64 becomes clogged.

Figure 4:
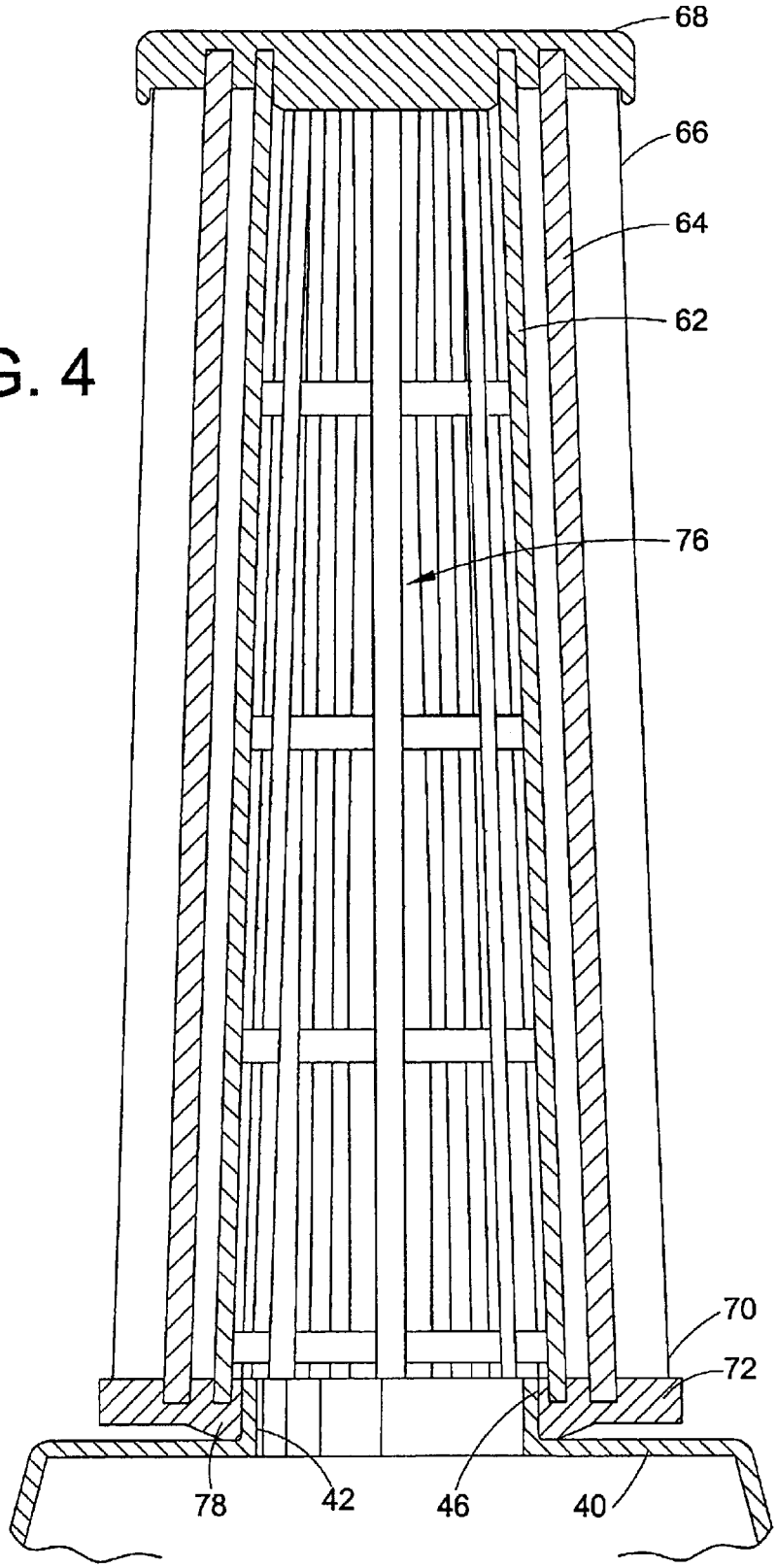
FIG. 4 is an enlarged, partial cross-sectional view of the filter assembly of FIG. 3.

With additional reference to FIG. 4, at a first or smaller diameter end 66 of the filter assembly 60, a rigid filter cap 68 is overmolded onto the frame 62 and the filter element 64. Similarly, at a second or larger diameter end 70 that is adjacent the base wall 40, an elastomeric annular seal 72 is overmolded onto the frame 62 and the filter element 64. The seal 72 includes an aperture 74 (FIG. 6) therethrough that communicates with a central region 76 of the filter assembly 60. Aside from entering through the aperture 74, the overmolded filter cap 68 and elastomeric seal 72 prevent airflow from entering the central region 76 of the filter assembly 60 without passing through the filter element 64.

The generally conical-shaped filter assembly 60 is mounted to the lower end 40 of the dirt cup 36 (FIG. 3). More specifically, the elastomeric seal 72 is selectively engaged to the annular flange 48 of the lower end 40 via an interference fit between the seal aperture 74 and an outer surface of the annular flange 48 such that the filter assembly 60 is releasably yet securely retained in its operative position, even when the dirt cup 36 is removed from the vacuum cleaner A and inverted for purposes of emptying the contents thereof. The elastomeric seal 72 includes an annular lip 78 surrounding the aperture 74 that further seals between the filter assembly 60 and the lower end 40 of the dust cup 36. Of course, the filter 76 can be removed from the dirt cup 36 for cleaning. The filter material can be made from a suitable conventional thermoplastic so that the filter 76 can be washed, if so desired.

With specific reference to FIG. 3, at the open upper end 44 of the dirt cup 36, the dirt cup cap 38 is capable of releasably connecting to the dirt cup 36 and closing the open upper end 44. More specifically, the cap 38 includes a skirt 82 having an inner diameter that is slightly larger than an outer diameter of the dirt cup 36. The cap 38 further includes a shoulder portion 84. The shoulder portion 84 includes an annular groove 86 for seating an annular elastomeric seal 88. When the cap 38 is connected to the dirt cup 36, the open upper end 44 of the dirt cup 36 abuts or seats against the elastomeric seal 88 thereby sealing the connection between the cap 38 and the dirt cup 36.

A locking means may be provided for selectively locking the cap 38 to the dirt cup 36. With reference to FIG. 7, in the embodiment illustrated, the locking means includes a plurality of protrusions 90 extending from an exterior surface of the dirt cup 36 and a corresponding number of covered receiving recesses or slots 92 on the cap 38. The slots 92 are tapered or cammed such that when the protrusions 90 are advanced along the slots 92 to lock the cap 38 to the dirt cup 38, the cap 38 advances toward and relative to the dirt cup 38 thereby compressing the seal 88 between the cap 38 and the dirt cup 36 and improving the sealing effect therebetween. Of course, one skilled in the art will readily recognize that the locking mechanism could be reversed such that the protrusions could be on the cap 38 and the slots could be on the dirt cup 36 or, alternatively, the bayonet-type locking mechanism of the illustrated embodiment could be entirely substituted for by another known locking assembly. All known locking mechanisms and assemblies for connecting the cap 38 to the dirt cap 36 are to be considered within the scope of the present invention.

The cap 38 includes a handle 94 to facilitate handing of the dirt cup and cap assembly 36,38 and/or removal of the cap 38 from the dirt cup 36. With reference to FIG. 3, the cap 38 further includes a cap cavity 96 that forms a portion of the chamber 34 when the cap 38 is connected to the dirt cup 36. The cap cavity 96 is generally cylindrical and open at one end for connecting to the dirt cup 36. The cap cavity 96 is defined by a generally circular side wall 98 and a base wall 100. With additional reference to FIG. 10, the side wall 98 defines an airflow chamber inlet or aperture 102 that communicates with the cap cavity 96. A wall section 104 directs airflow entering the cap cavity 96 or the cyclonic airflow chamber 34 through the aperture 102 in a generally tangential orientation relative to the cylindrical airflow chamber 34. An annular groove 106 defined on an exterior side of the side wall 98 surrounds the aperture 102. An elastomeric seal 108 is received or seated within the annular groove 106.

Figure 10:
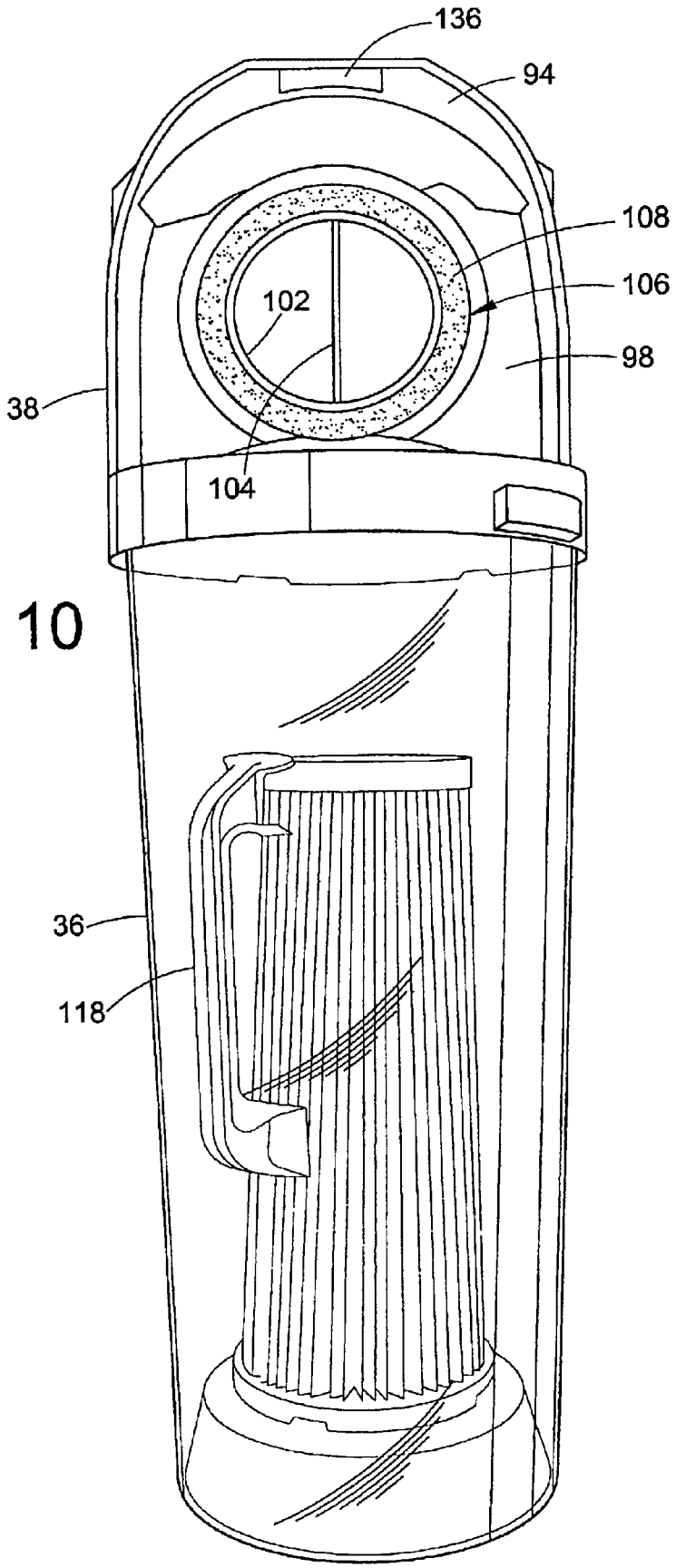
FIG. 10 is an enlarged rear elevational view of the dirt cup and cap assembly of FIG. 9.

The dirt cup 36 and cap 38 may form a part of the upright housing section B or may be selectively removed from the upright housing section B. When forming a part of the upright housing section B, the dirt cup 36 is capable of receiving and retaining dust and dirt from a suction airstream produced by the vacuum cleaner A. When removed from the upright section B, the cap 38 is removable from the dirt cup 36 and the dust and dirt retained in the dirt cup 36 may be emptied therefrom. With reference to FIG. 10, the dirt cup 36 includes a handle 118 to facilitate handling of the dirt cup and cap assembly 36,38 and removal of the cap 38 from the dirt cup 36. As shown, the dirt cup 36 may be formed of a transparent material to reveal the chamber 34 and the filter assembly 60. Alternatively, the dirt cup 36 may be formed of any other suitable material.

Figure 9:
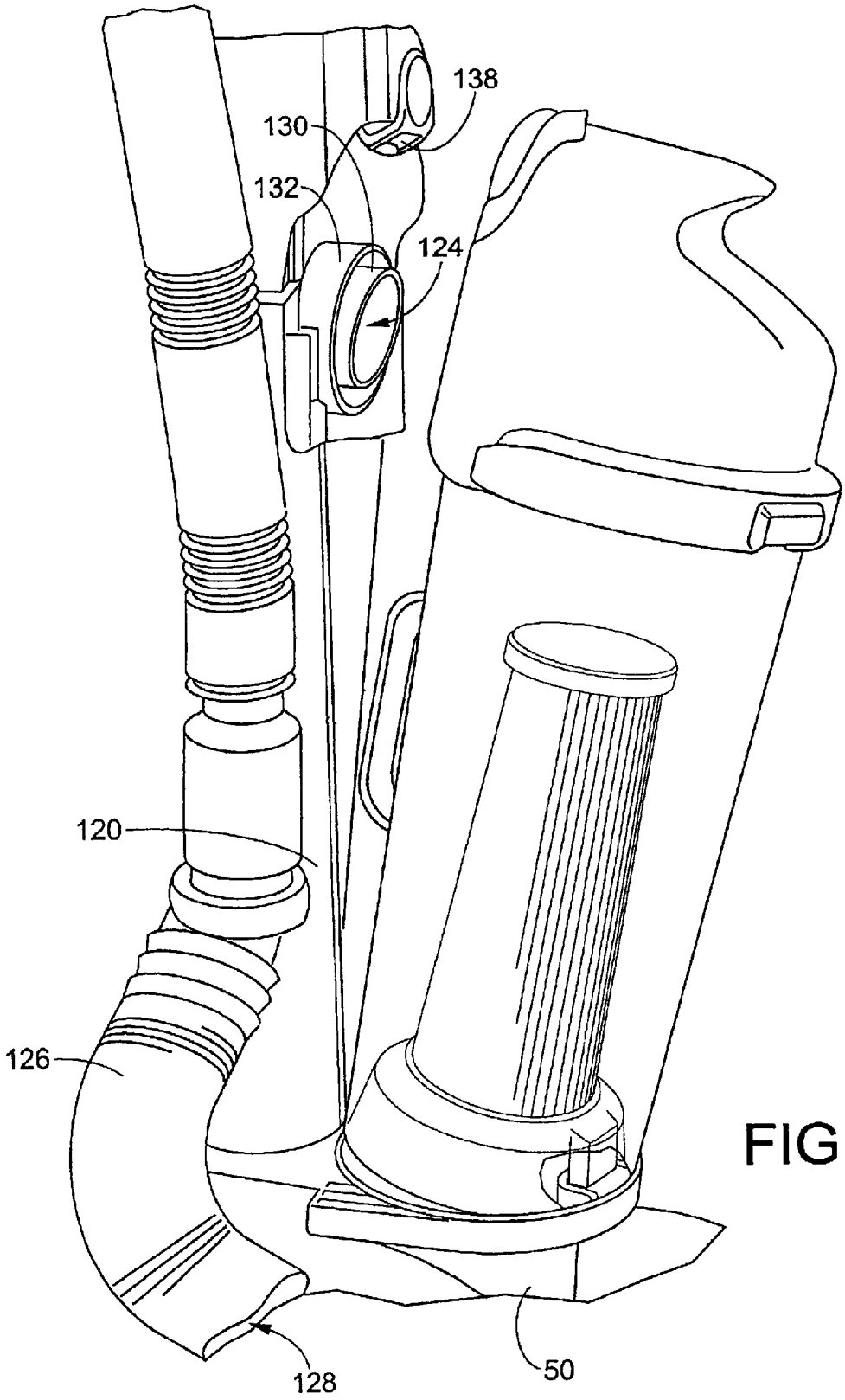
FIG. 9 is an enlarged partial perspective view of the vacuum cleaner of FIG. 1 showing the dirt cup and cap assembly partially removed from an upper housing of the vacuum cleaner.

With reference to FIGS. 1 and 9, the upright housing section B includes the handle 20, the receiving portion 50 and an elongated portion 120 connecting the handle 20 to the receiving portion 50. The elongated portion 120 includes an air passageway 122 (FIG. 2) defined therein, an upper opening 124 in fluid communication with the air passageway 122 and a hose 126 having an aperture 128 adjacent a distal end thereof and in fluid communication with the air passageway 122.

The upper opening 124 includes an inner annular flange 130 that defines the upper opening 124 and an outer annular flange 132 of a larger diameter than the inner annular flange 130 spaced from the inner annular flange 130. The inner annular flange 130 has an outer diameter that is slightly smaller than the inner diameter of the cap aperture 102 (FIG. 10). Thus, the inner annular flange 124 is appropriately sized to be received within the aperture 102 of the cap 38 and has a substantially mating relation therewith. The outer annular flange 130 is appropriately sized to mate with the elastomeric seal 108 of the cap 38 to seal the connection between the elongated portion 120 and the cap 38.

The upper housing section B includes a latch mechanism 134 (FIG. 5) to retain the dirt cup and cap assembly 36,38 in its operative position. The latch mechanism 134 includes an opening 136 (FIG. 10) in the cap 38 and a corresponding tab 138 disposed on the elongated portion 120. When the dirt and cap assembly 36,38 is seated within or attached to the upper housing B, the tab 138 is bias toward a locked position wherein the tab 138 is received in the opening 136 and prevents the removal of the dirt cup and cap assembly 36,38 from the upper housing B. When the dirt cup and cap assembly 36,38 is part of the upper housing B, the tab 138 is movable from the locked position to an unlocked position whereby the dirt cup and cap assembly 36,38 may be pivoted forward and removed from the upper housing B.

The bias tab 138 pivotally moves between the locked position and the unlocked position. When desirable to reattach a removed dirt cup and cap assembly 36,38 to the upper housing B, the dirt cup 38 with the cap 38 connected thereto is seated in the cup-shaped receiving portion 50 of the upper housing B at a slight angle, as shown in FIG. 9. With additional reference to FIG. 7, the protrusion 54 is received in the protrusion pocket 56. The assembly 36,38 is then pivoted into its operative and upright position. During this pivoting motion, a portion of the handle 94 of the cap 38 adjacent the opening 136 engages the tab 138 and moves or pivots the tab 138 to its unlocked position until the assembly 36,38 is in fully in position. The tab 138 then returns to its locked position whereby it retains the assembly 36,38 on the housing B.

Figure 12:
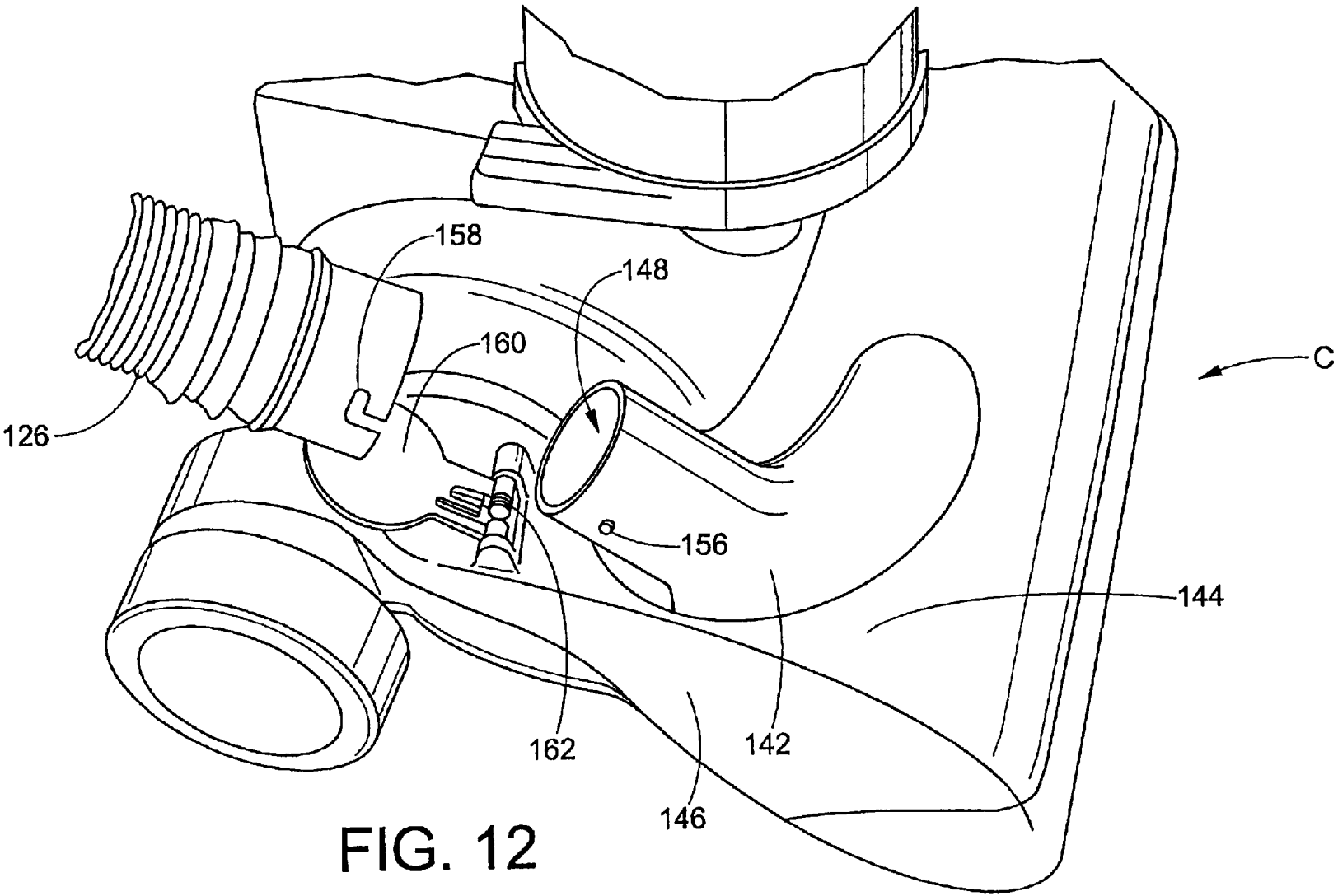
FIG. 12 is an enlarged partial perspective view of the vacuum cleaner of FIG. 1 showing the detachable hose disconnected from a hose connector of the nozzle base.

With reference to FIG. 12, the nozzle base C includes a hose connector 142 disposed on and extending upward from an upper surface 144 of the nozzle base C. In particular, the hose connector 142 is disposed adjacent one side 146 of the nozzle base C on the upper surface 144 thereof. The hose connector 142 defines a hose connector opening 148 that is in fluid communication with the nozzle base main suction opening 24 (FIG. 11). The hose 126 of the upper housing B is selectively and releasably connectable to the hose connector 142 of the nozzle base C. When connected, the hose aperture 128 of the hose 126 directly and fluidly communicates with the hose connector opening 148 of the hose connector 142 thereby fluidly connecting the nozzle base section C and the upright section B.

Figure 5:
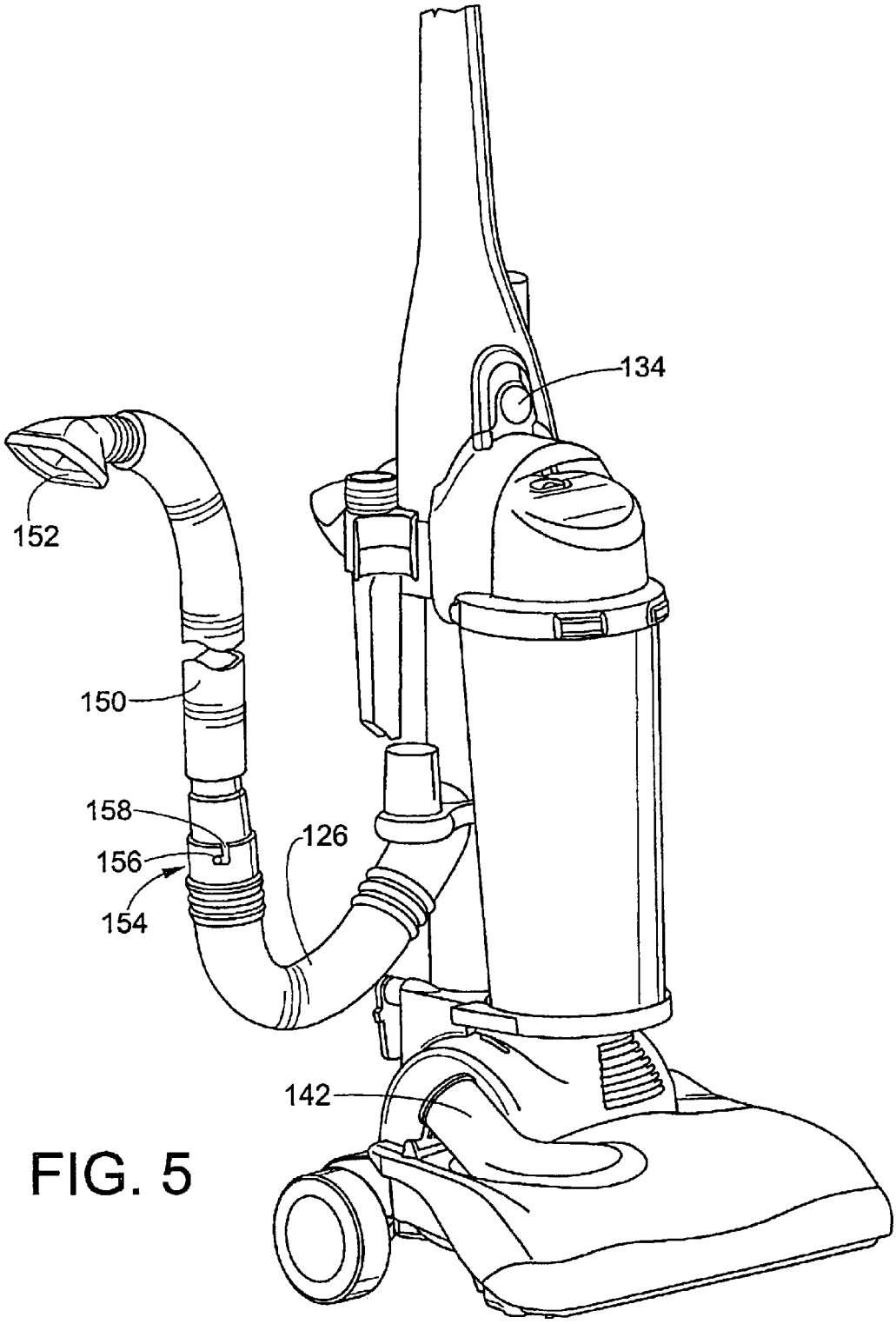
FIG. 5 is a perspective view of the vacuum cleaner of FIG. 1 showing the detachable hose connected to an auxiliary hose for above-floor cleaning.
Figure 8:
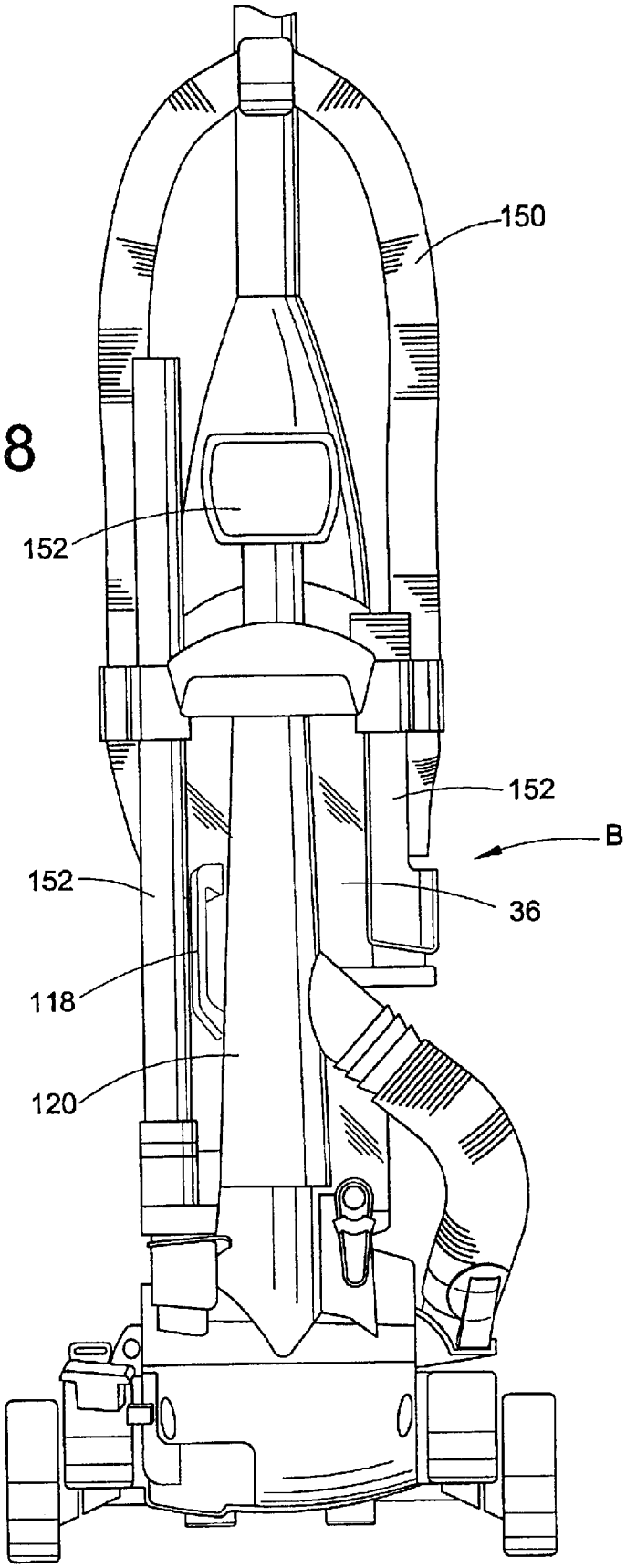
FIG. 8 is a rear elevational view of the vacuum cleaner of FIG. 1 wherein the vacuum cleaner is in a vertical storage position.

With additional reference to FIG. 5, the hose 126 is selectively detachable from the nozzle base C and can be selectively and releasably connected to one end of an auxiliary hose 150 for above-floor cleaning applications. An opposite end of the auxiliary hose 150 is adapted to be connected to one of a plurality of conventional cleaning tools 152. As shown in FIG. 8, the auxiliary hose 150 and the plurality of cleaning tools 152 can be carried on the upper housing section B for easy retrieval thereof.

Additionally, the vacuum cleaner A can include a means for disabling the brushroll 26 when the vacuum cleaner A is configured for above-floor cleaning. The means for disabling the brushroll 26 can be a mechanical device that disengages a belt used to drive the brushroll 26 when the handle 20 is in an upright position as is known in the art. Alternatively, a second motor could be used to drive the brushroll 26 and an electrical switch could be used to disable the brushroll motor such as when the handle is in the upright position. All known means for disabling the brushroll 26 are to be included within the scope of the present invention. It is further contemplated that the vacuum cleaner A may include no means for disabling the brushroll 26 when the cleaner A is configured for above-floor cleaning.

With reference again FIG. 5 and FIG. 12, a connection mechanism 154 is used to secure the hose 126 to one of the hose connector 142 and the auxiliary hose 150. In the embodiment illustrated, the connection mechanism 154 includes a pair of protrusions 156 (only one shown on each of the auxiliary hose 150 and the hose connector 142) and a pair of corresponding locking slots 158 (only one shown). More specifically, the hose connector 142 and the auxiliary hose 150 each include a like pair of protrusions 156 and the hose 126 includes the locking slots 158. Thus, the hose 126 can be selectively engaged to and releasably locked to either one of the hose connector 142 and the auxiliary hose 150. Of course, other known connection mechanisms can be used such as an interference fit connection, a threaded connection, etc. The type of connection illustrated herein is not intended to limit the present invention and all other known connections are to be considered within the scope of the present invention.

The nozzle base C additionally includes a cover 160 that in a closed position closes the hose connector opening 148. The cover 160 is generally urged toward the closed position by a bias means 162 such as a spring or the like. To connect the hose 126 to the hose connector 142 which establishes fluid communication between the hose aperture 128 and the hose connector opening or aperture 148, the cover 160 must be moved to an open position against the bias means 162 while the hose 126 is connected to the hose connector 142. Upon removal of the hose 126 from the hose connector 142, the cover 160 returns to its closed position.

With reference to FIG. 2, an air flow path or suction air stream is represented by arrows 162. As shown, when the hose 126 is connected to the hose connector 142, the air flow path flows from the nozzle base C and, in particular, the main suction opening 24 thereof, to the airflow chamber 34. In the airflow chamber 34, contaminants, such as dirt, dust and the like, are removed or separated from the suction air stream. More specifically, the location and orientation of the chamber inlet or aperture 102 and wall section 104, the location and orientation of the outlet or aperture 42, and the generally cylindrical configuration of the cyclonic airflow chamber 34 causes the suction airstream to follow a swirling or cyclonic path downward within the chamber 34. Air then flows radially inward through the filter element 64 to the suction source. Particulate matter is removed from the suction airstream as a result of the cyclonic path the airstream follows in the chamber 34. The removed particulate matter such as dirt, dust, etc., is received by the dirt cup 36 and retained therein until the dirt cup 36 is emptied. It has been observed that the conical or tapered shape of the filter assembly 60 enhances the removal effect of the cyclonic air flow path. Residual particulate matter, i.e., that which is not removed from the suction airstream as a result of the cyclonic action, is then filtered by the filter element 64 as the airflow path passes therethrough.

The location and orientation of the inlet 102 and wall section 104 will affect the direction of cyclonic airflow. However, it is contemplated that the inlet 102 and/or wall section 104 could be located and arranged differently such that the direction of cyclonic airflow could be reversed. Thus, the cyclonic airflow direction could be clockwise or counterclockwise depending upon the location and arrangement of the inlet 102 and the wall section 104. All such orientations and arrangements are considered within the scope of the present invention and, accordingly, the invention should not be limited to a particular direction of airflow.

Further, those skilled in the art will certainly recognize that the term "cyclonic" as used herein is not meant to be limited to a particular direction of airflow rotation. The cyclonic action of the present invention merely separates a substantial portion of the entrained dust and dirt from the suction airstream and causes the dust and dirt to be deposited in the dirt cup 36. The suction airstream then passes through the filter element 64 so that residual contaminants are removed, and exits the cyclonic chamber 34 through the aperture 42. The suction airstream is then communicated to the motor and fan assembly and exhausted from the vacuum cleaner A. It should also be recognized that dust separation can also occur via a non-cyclonic airflow and that filter could be so shaped and positioned in the dirt cup as to cause a non-cyclonic airflow within the dirt cup.

With reference to FIG. 8, the position of the handle 118 on the dirt cup 36 relative to the protrusion 54 is such that when the dirt cup 36 is attached to the upper housing B, the handle 118 does not conspicuously protrude from the dust cup 36 but, rather, fits between the elongated section 120 and the auxiliary hose 152. As a result, the vacuum cleaner A is more compact and occupies less overall volumetric space as a result of this arrangement.

The invention has been described with reference to a preferred embodiment. Obviously, modifications and alteration will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. An upright vacuum cleaner comprising:

a nozzle base section including a main suction opening formed in an underside thereof;

an upright housing section hingedly connected with said nozzle base section, said housing section including a dirt separation chamber and a dirt receptacle for receiving dirt and dust separated by said dirt separation chamber;

a hose connecting said nozzle base section to said housing section, said hose communicating an air stream that flows from said main suction opening to said dirt separation chamber;

a suction source located in one of said housing section and said nozzle base section and in fluid communication with said dirt separation chamber;

a filter assembly located in the dirt separation chamber and in fluid communication with said suction source; and, a hose connector disposed on and extending away from an upper surface of said nozzle base section, said hose connector being in fluid communication with said main suction opening, said hose being selectively detachable from said hose connector to enable use of the vacuum cleaner for above floor cleaning.

2. The upright vacuum cleaner of claim 1 wherein said hose connector includes protrusions and said hose includes slots for receiving said protrusions to releasably connect said hose and said hose connector together.

3. The upright vacuum cleaner of claim 2 further including an auxiliary hose having protrusions capable of being received in said slots of said hose for connecting said hose to said auxiliary hose.

4. The upright vacuum cleaner of claim 1 wherein said filter assembly includes a generally frustoconical filter element.

5. The upright vacuum cleaner of claim 1 wherein said filter assembly includes a tapered filter element.

6. The upright vacuum cleaner of claim 1 wherein said hose includes a connector member to allow the hose to be connected to an above-floor tool, when it is disconnected from said hose connector on said nozzle base section.

7. The upright vacuum cleaner of claim 1 wherein said dirt separation chamber is defined by the dirt receptacle and a cap that is removably connected to the dirt receptacle.

8. The vacuum cleaner of claim 1 wherein said hose connector extends at an acute angle in relation to a horizontal plane.

9. A vacuum cleaner comprising:

a housing defining a cyclonic airflow chamber for separating contaminants from a suction airstream, said housing further comprising an inlet for said cyclonic airflow chamber and an outlet for said cyclonic airflow chamber;

a dirt container selectively mounted in said housing for receiving and retaining dirt and dust separated from said suction airstream;

an airstream suction source in fluid communication with said cyclonic airflow chamber and having an inlet disposed downstream from said cyclonic airflow chamber outlet; and a generally conical-shaped filter assembly positioned between said cyclonic airflow chamber and said suction source for filtering contaminants from said suction airstream; wherein said filter assembly has a first end and a second end opposite said first end, wherein said second end has a diameter larger than said first end and wherein said first end includes a rigid end cap which prevents a flow of air therethrough.

10. The vacuum cleaner of claim 9 wherein said filter assembly includes a generally cylindrical filter having tapered walls.

11. The vacuum cleaner of claim 10 wherein said filter includes a pleated filter medium.

12. The vacuum cleaner of claim 9 wherein said filter assembly further includes a support member on which said filter is mounted.

13. A vacuum cleaner comprising:

a first housing member comprising a cyclonic airflow chamber adapted for separating entrained dirt and dust from a circulating airstream;

a tapered filter mounted in said cyclonic chamber;

a second housing member defining a main suction opening;

a first conduit fluidly connecting said main suction opening to an inlet of said cyclonic airflow chamber, at least a portion of said first conduit being selectively releasable from said second housing member; and an airstream source mounted to one of said first and second housing members and positioned downstream from said cyclonic airflow chamber, said airstream source being located beneath said cyclonic airflow chamber and being adapted for generating and maintaining an airstream flowing through said cyclonic airflow chamber.

14. The vacuum cleaner of claim 13 wherein said at least a portion of said first conduit is selectively releasable from a top surface of said second housing member.

15. The vacuum cleaner of claim 14 wherein said top surface includes a hose connector extending upward therefrom that defines a hose connector opening that is in fluid communication with said main suction opening.

16. The vacuum cleaner of claim 13 further comprising a dust cup releasably mounted to one of said first and second members, said dust cup holding dirt and dust separated by said cyclonic airflow chamber.

17. The vacuum cleaner of claim 13 further comprising:

an exit opening of said cyclonic airflow chamber, said exit opening being located adjacent a lower end of said cyclonic airflow chamber.

18. A vacuum cleaner comprising:

a nozzle section;

a housing section connected to said nozzle section and in fluid communication with said nozzle section;

a dirt separation chamber located in said housing section for separating dirt and dust from a suction airstream flowing into said housing section between an inlet of said housing section and an outlet;

a suction source in fluid communication with said dirt separation chamber; and a tapered filter assembly located in said dirt separation chamber for further separating dirt and dust from said suction airstream; said filter assembly comprising a first end and a second end; wherein said first end is larger in diameter than said second end; and wherein said first end is positioned adjacent a lower end of the dirt separation chamber.

19. The vacuum cleaner of claim 18 wherein said filter assembly includes a frustoconical frame and a frustoconical filter media annularly positioned on said frame.

20. The vacuum cleaner of claim 19 wherein said filter media comprises a pleated material.

21. The vacuum cleaner of claim 18 wherein said fluid communication between said nozzle section and said housing section is through a hose that is detachable from one of said nozzle and said housing.

22. The vacuum cleaner of claim 21 wherein said hose is detachable from said nozzle section.

23. A vacuum cleaner comprising:

a housing including a suction opening thereon;

a dust cup removably mounted in said housing in fluid communication with said suction opening;

a tapered filter mounted in said dust cup such that a larger diameter end is located adjacent a base wall of said dust cup; and a suction source in fluid communication with said dust cup and located downstream of said dust cup for generating and maintaining a suction airstream from said suction opening through said tapered filter.

24. The vacuum cleaner of claim 23 wherein said dust cup includes an outlet located in said base wall, said outlet in fluid communication with said suction source.

25. The vacuum cleaner of claim 23 wherein said suction source is positioned below said dust cup.

26. The vacuum cleaner of claim 23 wherein said dust cup includes a handle thereon for facilitating handling of said dust cup.

27. The vacuum cleaner of claim 26 wherein said handle is positioned on said dust cup such that when said dust cup is mounted in said housing said handle is adjacent said housing and does not conspicuously protrude therefrom.

28. The vacuum cleaner of claim 23 further including a dust cup cap connected to said dust cup to close an open side of said dust cup, said cap including an aperture therethrough.

29. The vacuum cleaner of claim 28 wherein said cap includes a handle thereon for facilitating handling of said cap.

30. The vacuum cleaner of claim 28 wherein said cup includes a wall section that directs air entering the cap aperture in a generally tangential orientation relative to the dust cup.

31. The vacuum cleaner of claim 28 further including a locking means for connecting and securing said cap to said dust cup.

32. The vacuum cleaner of claim 31 wherein said locking means is a bayonet-type locking mechanism.

33. The vacuum cleaner of claim 28 wherein said dust cup cap includes an opening and said housing includes a tab receivable in said cap opening, said tab movable between a locked position wherein said tab is capable of retaining said dust cup and cap within said housing and an unlocked position wherein said dust cup and cap are removable from said housing without interference from said tab.

34. The vacuum cleaner of claim 23 wherein said dust cup includes a protrusion and said housing includes a protrusion pocket for receiving said protrusion to align said dust cup relative to said housing, said protrusion pivotable within said protrusion pocket.

35. An upright vacuum cleaner comprising:

a nozzle base section including a top surface, a bottom surface, a main suction opening formed in said bottom surface, and a hose connector extending away from said top surface at an acute angle to a horizontal plane;

an upright housing section hingedly connected with said nozzle base section, said housing section including a filter chamber for separating dirt and dust from an airstream flowing through said filter chamber;

a hose connecting said nozzle base section to said upright housing section, said hose being selectively detachable from said hose connector, said hose, when connected to said hose connector, communicating the air stream that flows from said main suction opening to said filter chamber, wherein said hose extends from said nozzle base top surface to said upright housing section; and, a suction source located in one of said upright housing section and said nozzle base section and in fluid communication with said filter chamber.

36. The upright vacuum cleaner of claim 35 wherein said nozzle base section top surface includes a side edge and said hose connector is located adjacent said side edge.

37. The upright vacuum cleaner of claim 35 wherein one of said hose connector and said hose includes protrusions and another of said hose connector and said hose includes slots for receiving said protrusions to releasably connect said hose and said hose connector together.

38. The upright vacuum cleaner of claim 35 wherein the upright vacuum cleaner includes a central longitudinal axis extending through said upright housing section and wherein a first end of said hose, which is selectively detachable from said nozzle base section, is spaced from said central longitudinal axis.

39. An upright vacuum cleaner comprising:

a nozzle base section including a main suction opening formed in an underside thereof;

an upright housing section hingedly connected with said nozzle base section, said upright housing section including a filter chamber for separating dirt and dust from an airstream flowing through said filter chamber;

a filter element mounted to said filter chamber, a dust cup selectively connected to said upright housing section and fluidly connected to said filter chamber;

a hose having a first end connected to said nozzle base section and a second end connected to said upright housing section, said hose communicating an air stream that flows from said main suction opening to said filter chamber;

a suction source located in one of said upright housing section and said nozzle base section and in fluid communication with said filter chamber; and, a longitudinal axis extending from said nozzle base section through said upright housing section, wherein said hose first end is spaced from said longitudinal axis and is located adjacent a side edge of said nozzle base section for ease of disconnection when the vacuum cleaner is used for above floor cleaning.

40. The upright vacuum cleaner of claim 39 wherein the nozzle base section includes an upper surface having a hose connector defining a hose connector opening for connecting said hose first end to said nozzle base section, said hose connector opening being in fluid communication with said main suction opening.

41. The upright vacuum cleaner of claim 40 wherein one of said hose connector and said hose includes protrusions and another of said hose connector and said hose includes slots for receiving said protrusions to releasably connect said hose and said hose connector together.

42. The upright vacuum cleaner of claim 39, wherein a filter chamber outlet is oriented parallel to said longitudinal axis.

43. The upright vacuum cleaner of claim 39 wherein said hose second end is located adjacent said longitudinal axis.

44. The upright vacuum cleaner of claim 39 wherein said hose second end is connected to a rear side of upright housing section.

45. A vacuum cleaner comprising:

a nozzle base including a pair of opposed side edges and a hose connector located adjacent one of said pair of opposed side edges;

a housing defining a filter chamber for separating contaminants from a suction airstream, wherein said housing is pivotally mounted on said nozzle base, said housing further comprising an inlet for said filter chamber and an outlet for said filter chamber;

a dirt container selectively mounted in said housing for receiving and retaining dirt and dust separated from said suction airstream;

a filter mounted in said dirt container;

an airstream suction source in fluid communication with said filter chamber and having an inlet disposed downstream from said filter chamber outlet; and a hose extending from said nozzle base to said housing, wherein said hose is mounted to said hose connector.

46. The vacuum cleaner of claim 45 wherein said hose is selectively detachable from said hose connector.

47. The vacuum cleaner of claim 45 further comprising a support member on which said filter is mounted.

48. A vacuum cleaner comprising:

a first housing member comprising a filter chamber adapted for separating entrained dirt and dust from a circulating airstream, said filter chamber including an inlet and an outlet;

a second housing member defining a main suction opening, wherein said first housing member is pivotally mounted on said second housing member;

a dust cup releasably mounted to one of said first and second housing members, said dust cup holding dirt and dust separated by said filter chamber; said dust cup including a base wall;

a filter member mounted to said dust cup adjacent said base wall;

a first conduit fluidly connecting said main suction opening to said inlet of said filter chamber, wherein said first conduit is selectively releasable from said second housing member; and, an airstream source mounted to one of said first and second housing members and positioned downstream from said outlet of said filter chamber, said airstream source being adapted for generating and maintaining an airstream flowing through said filter chamber.

49. The vacuum cleaner of claim 48 wherein said first conduit is selectively releasable from a top surface of said second housing member.

50. The vacuum cleaner of claim 49 wherein said top surface includes a hose connector extending upward therefrom that defines a hose connector opening which is in fluid communication with said main suction opening.

51. The vacuum cleaner of claim 50 wherein said hose connector is located adjacent a side edge of said second housing member.

52. The vacuum cleaner of claim 48 wherein said filter member comprises a pleated filter medium.

53. The vacuum cleaner of claim 48, wherein said dust cup comprises a flange, wherein said filter member is seated on said flange.

* * * * *